US008317476B1

(12) United States Patent
Liang

(10) Patent No.: US 8,317,476 B1
(45) Date of Patent: Nov. 27, 2012

(54) TURBINE BLADE WITH TIP COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 396 days.

(21) Appl. No.: 12/834,071

(22) Filed: Jul. 12, 2010

(51) Int. Cl.
*F01D 5/08* (2006.01)

(52) U.S. Cl. ..... 416/97 R; 416/224

(58) Field of Classification Search ..... 416/92, 416/224, 228

See application file for complete search history.

(56) References Cited

U.S. PATENT DOCUMENTS 4,390,320 A * 6/1983 Eiswerth ..... 416/97 R
2005/0111979 A1* 5/2005 Liang ..... 416/97 R

* cited by examiner

*Primary Examiner* — Richard Edgar
(74) *Attorney, Agent, or Firm* — John Ryznic

(57) ABSTRACT

A turbine rotor blade with a blade tip cooling circuit that is formed by bonding a blade tip to a top side of an airfoil. The blade tip includes a first series of ribs formed on a bottom side that defines a first layer of tip cooling holes. The top side of the airfoil includes a second series of ribs that define a second layer of cooling holes. The first and second series of ribs are formed before the blade tip is bonded to the airfoil to enclose the two layers of tip cooling holes that open onto the walls of the blade below the tip edge.

5 Claims, 1 Drawing Sheet

TURBINE BLADE WITH TIP COOLING CIRCUIT

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to turbine rotor blade with blade tip cooling.

2. Description of the Related Art including information disclosed under 37 CFR 1.97 and 1.98

A gas turbine engine, such as a large frame heavy duty industrial gas turbine (IGT) engine, includes a turbine with one or more rows of stator vanes and rotor blades that react with a hot gas stream from a combustor to produce mechanical work. The stator vanes guide the hot gas stream into the adjacent and downstream row of rotor blades. The first stage vanes and blades are exposed to the highest gas stream temperatures and therefore require the most amount of cooling.

The efficiency of the engine can be increased by using a higher turbine inlet temperature. However, increasing the temperature requires better cooling of the airfoils or improved materials that can withstand these higher temperatures. Turbine airfoils (vanes and blades) are cooled using a combination of convection and impingement cooling within the airfoils and film cooling on the external airfoil surfaces.

The turbine rotor blades have blade tips that form a gap with a blade outer air seal (BOAS) on the stationary housing. This blade tip gap varies in spacing due to engine operation. Hot gas flow will leak through the gap and cause erosion damage to the tip that eventually wears away pieces of the tip that will then further increase the tip leakage flow, which then further causes additional erosion damage.

Prior art blade tips are cooled by drilling holes into the upper extremes of a serpentine flow cooling circuit formed within the airfoil of the blade with cooling holes that open onto the pressure and suction side surfaces just below the blade tip corners along the blade tip edge and on top of the blade tip floor that opens into a squealer pocket. As a result of this cooling design, cooling flow distribution and pressure ratios across these film cooling holes for the airfoil pressure and suction sides as well as the tip cooling holes are predetermined by the internal cavity pressure. In addition, the blade tip region is subject to severe secondary flow field which therefore requires a large number of film cooling holes and cooling flow required for the cooling of the blade tip periphery.

BRIEF SUMMARY OF THE INVENTION

A turbine rotor blade with a tip cap bonded to the blade airfoil, where a bottom side of the tip cap has a first series or ribs that extend toward the sides and form cooling channels, and where a top side of the airfoil on which the blade tip is bonded to has a second series of ribs that extend toward the sides but at around 90 degrees to the first series of ribs to form a criss-cross pattern of cooling channels along the blade tip. The blade tip cooling channels open onto the pressure and suction sides of the airfoil just below the tip edges to discharge film cooling air. The blade tip cooling channels are supplied by a series of core print-out holes that are connected to an internal blade cooling circuit.

The series of ribs on the blade tip and the airfoil can be formed during casting of these parts, or they can be machined into these parts after casting. A bonding process such as a transient liquid phase (TLP) bonding process can be used to secure the blade tip to the blade airfoil.

DETAILED DESCRIPTION OF THE INVENTION

Figure 1:
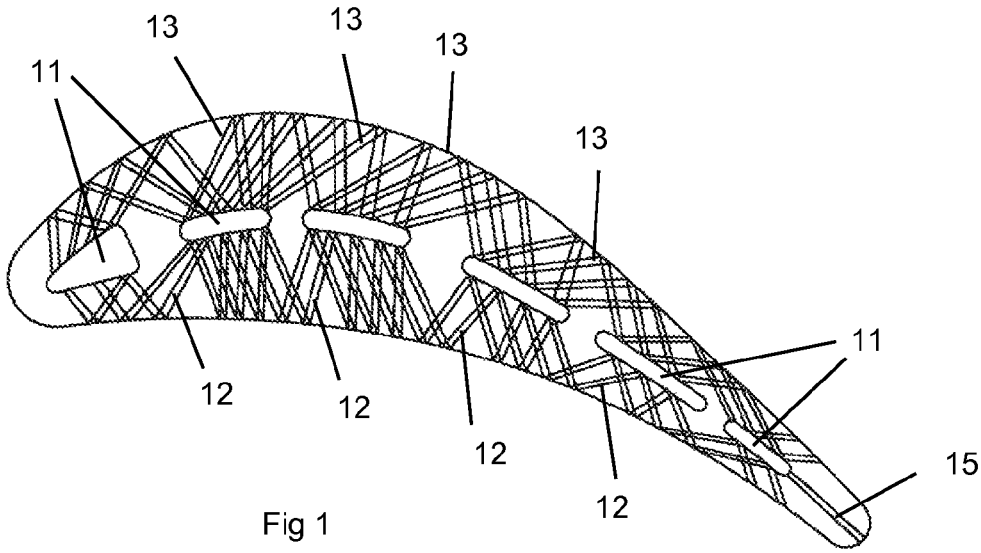
FIG. 1 shows a cross section top view of the blade tip cooling circuit for the blade of the present invention.
Figure 2:
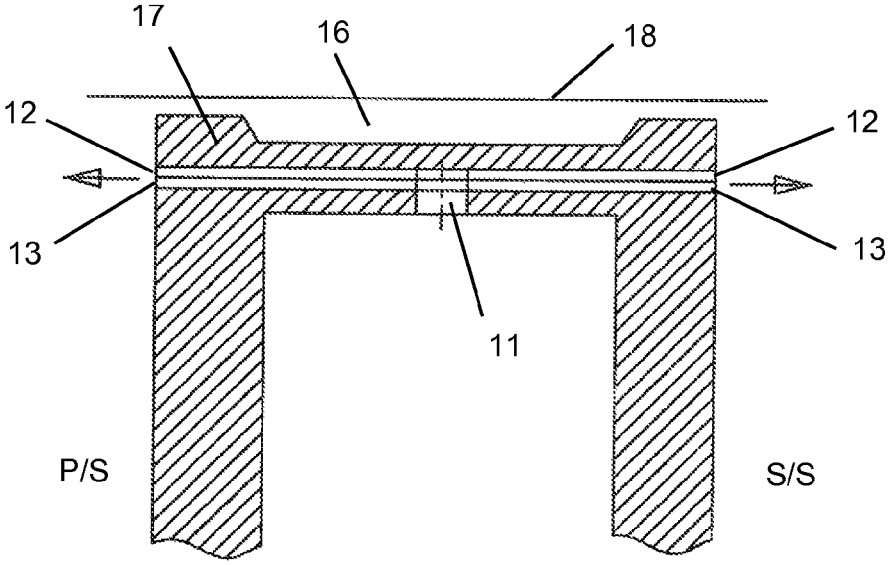
FIG. 2 shows a cross section side view of the blade tip cooling circuit for the blade of the present invention.

A turbine rotor blade with a blade tip cooling circuit that can be used in a gas turbine engine, such as a heavy duty industrial gas turbine engine in which the engine operates for relatively long periods of time under steady state conditions. The blade of the present invention is shown in FIGS. 1 and 2 and includes an airfoil having a pressure side (P/S) wall and a suction side (S/S) wall and a top surface. A blade tip 17 is bonded to the top surface to form a finished blade. The blade tip cooling circuit includes two layers of tip cooling channels that extend from a series of core print-out holes 11 to supply cooling air. FIG. 1 shows a first or top layer of cooling channels 12 and a second or bottom layer of cooling channels 13. The two layers of cooling channels are offset from one another so that a criss-cross flow pattern is formed in the cooling air. The cooling channels 12 and 13 are formed by ribs that extend from the core print-out holes 11 to the side of the walls of the blade. a trailing edge exit hole 15 is connected to the printout hole 11 adjacent to the trailing edge region to provide cooling for the T/E tip region of the blade tip.

FIG. 2 shows the two layers of cooling holes 12 and 13 with the top layer 12 formed by ribs on a bottom surface of the tip cap 17 and the bottom layer 13 formed by ribs on the top surface of the airfoil. The ribs that form the cooling channels 12 and 13 can be formed on the tip cap and the airfoil top surface during the casting process or after casting by machining. With the two layers of cooling channels 12 and 13 formed on the tip cap 17 and the airfoil, the tip cap is bonded to the airfoil to enclose the two layers of cooling channels 12 and 13 and to secure the blade tip to the airfoil to form a complete blade.

The top layer of cooling holes are slanted toward the leading edge side of the blade while the bottom layer of cooling channels 13 are slanted toward the trailing edge side to form the criss-cross flow pattern for the cooling air. This criss-cross pattern will produce a high level of mixing of the cooling air and therefore an increase in the heat transfer coefficient for the blade tip cooling circuit. A squealer pocket 16 is formed on the blade tip by tip rails that extend around the periphery of the tip. The squealer pocket can be cast into the blade tip or machined after the blade tip has been cast. The blade tip forms a seal with a blade outer air seal or BOAS of the turbine. The two layers of cooling holes 12 and 13 can be formed close together so that a more dense arrangement of tip cooling holes can be formed than in the prior art drilled tip periphery film cooling holes.

Cooling air flowing through the core print-out holes 11 will first impinge onto a bottom side of the blade tip to provide cooling for the tip floor of the squealer pocket, and then flow through the first and second layers of cooling holes formed between the tip cap and the top surface of the airfoil. The two layers of cooling holes 12 and 13 open onto the side walls of the airfoil just underneath the tip edges to provide film cooling for the tip corners. The cooling holes 12 and 13 extend all along the P/S and S/S walls of the blade to provide cooling for the entire blade tip. The gaps shown in FIG. 1 are left so that details can be seen. In the real blade, no gaps would be used.

The advantages of the blade tip cooling circuit of the present invention over the prior art blade tip cooling design are described below. Elimination of welding of blade core printout holes. Elimination of drilling of the blade tip cooling holes, since the entire cooling circuit is fabricated into the airfoil tip cap, drilling of the cooling holes around the blade tip edge and blade top surface can be eliminated which will reduce the blade manufacturing cost and improve the blade life cycle cost.

Higher overall blade tip cooling effectiveness is achieved since the coolant air is used first to cool the blade top surface by means of channel convection cooling, and then discharged onto the airfoil surface as film cooling air. A higher heat transfer coefficient is generated by the mixing in the criss-cross cooling flow channels. Also, a higher external film effectiveness level is produced by the peripheral film holes than by the prior art film hole which yields a cooler blade tip.

A cooler blade squealer tip is produced by the present invention. Since the film holes are much closer to the squealer tip than in the prior art drilled film cooling holes, the conduction distance for the cooling air is reduced and yields a much lower metal temperature.

A reduction of the blade tip leakage flow and blade tip section heat load is produced by the present invention. The film cooling holes injects cooling air at a much closer distance to the blade tip gap than in the prior art blade peripheral film holes.

I claim the following:

1. A turbine rotor blade comprising:

an airfoil with a pressure side wall and a suction side wall;

the airfoil having a top surface for a tip cap and a series of core printout holes extending from near to a leading edge to near to a trailing edge of the airfoil, the core printout holes forming cooling air supply holes for a blade tip cooling circuit;

a blade tip secured to the top surface of the airfoil;

a first layer of tip cooling holes and a second layer of tip cooling holes both formed between the airfoil top surface and a bottom side of the blade tip;

the first layer of tip cooling holes forming a criss-cross flow pattern with the second layer of tip cooling holes.

2. The turbine rotor blade of claim 1, and further comprising:

the first layer of tip cooling holes are slanted toward the leading edge; and, the second layer of tip cooling holes are slanted toward the trailing edge.

3. The turbine rotor blade of claim 1, and further comprising:

the first and second layers of tip cooling holes open onto the pressure and suction side walls of the airfoil just below the tip edge of the blade tip.

4. The turbine rotor blade of claim 3, and further comprising:

the first and second layers of tip cooling holes open onto the pressure and suction side walls from a leading edge region and extend along both walls to a trailing edge region.

5. A process of forming an air cooled turbine rotor blade for a gas turbine engine, the process comprising the steps of:

forming an airfoil section having a pressure side wall and a suction side wall with a series of core printout holes extending from a leading edge region to a trailing edge region of the airfoil;

forming a blade tip with a first series of ribs on a bottom side of the blade tip;

forming a second series of ribs on a top side of the airfoil in which one series of ribs slants toward a leading edge of the airfoil and the other series of ribs slants toward a trailing edge of the airfoil; and, bonding the blade tip to the top side of the airfoil to enclose the first and second series of ribs to form first and second series of cooling channels that are connected to the core printout holes and open onto the two walls of the airfoil.

* * * * *